US008270857B2

(12) United States Patent
Saitou et al.

(10) Patent No.: US 8,270,857 B2
(45) Date of Patent: Sep. 18, 2012

(54) IMAGE FORMING APPARATUS

(75) Inventors: Kanou Saitou, Saitama (JP); Mitsunori Shioi, Saitama (JP); Hajime Misumi, Saitama (JP); Fujio Osawa, Saitama (JP); Susumu Takagaki, Saitama (JP); Yuji Sato, Saitama (JP); Tadakazu Tsutehira, Saitama (JP); Hideo Kageyama, Saitama (JP); Takashi Kubo, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 116 days.

(21) Appl. No.: 12/546,402

(22) Filed: Aug. 24, 2009

(65) Prior Publication Data

US 2010/0239279 A1 Sep. 23, 2010

(30) Foreign Application Priority Data

Mar. 17, 2009 (JP) ..... 2009-064637

(51) Int. Cl.
*G03G 15/00* (2006.01)

(52) U.S. Cl. ..... 399/44; 399/49; 399/301

(58) Field of Classification Search ..... 399/9, 38, 399/44, 49, 72, 94, 297–301, 372, 394
See application file for complete search history.

(56) References Cited

U.S. PATENT DOCUMENTS

2005/0212887 A1 * 9/2005 Tanaka et al. ..... 347/116
2006/0029407 A1 * 2/2006 Sakamoto ..... 399/44

FOREIGN PATENT DOCUMENTS

JP A-2000-218860 8/2000

* cited by examiner

*Primary Examiner* — Walter L Lindsay, Jr.
*Assistant Examiner* — Benjamin Schmitt
(74) *Attorney, Agent, or Firm* — Oliff & Berridge, PLC

(57) ABSTRACT

A prediction table is stored in an NVM and an in-apparatus temperature is measured by a temperature sensor, a registration control adjustment based on the prediction table is carried out if an absolute value of a variation in the in-apparatus temperature is smaller than a threshold, and a registration adjusting patch is formed to actually measure a positional shift amount if the absolute value of the variation in the in-apparatus temperature is equal to or greater than the threshold. When the positional shift amount measured actually is greatly different from a value of the prediction table, the value of the prediction table is modified into the actually measured value.

7 Claims, 12 Drawing Sheets

FIG. 4A

| Color | TEMPERATURE | SHIFT AMOUNT |
|---|---|---|
| Yellow | 0°C | 0um |
| | 10°C | 150um |
| | 20°C | 400um |
| | 30°C | 500um |
| | 40°C | 550um |
| Magenta | 0°C | 0um |
| | 10°C | 150um |
| | 20°C | 400um |
| | 30°C | 500um |
| | 40°C | 550um |
| Cyan | 0°C | 0um |
| | 10°C | 150um |
| | 20°C | 400um |
| | 30°C | 500um |
| | 40°C | 550um |
| Black | 0°C | 0um |
| | 10°C | 150um |
| | 20°C | 400um |
| | 30°C | 500um |
| | 40°C | 550um |

FIG. 8A

| Color | TEMPERATURE | SHIFT AMOUNT |
|---|---|---|
| Yellow | 0°C | -150um |
| | 10°C | 0um |
| | 20°C | 250um |
| | 30°C | 350um |
| | 40°C | 400um |
| Magenta | 0°C | -150um |
| | 10°C | 0um |
| | 20°C | 250um |
| | 30°C | 350um |
| | 40°C | 400um |
| Cyan | 0°C | -150um |
| | 10°C | 0um |
| | 20°C | 250um |
| | 30°C | 350um |
| | 40°C | 400um |
| Black | 0°C | -150um |
| | 10°C | 0um |
| | 20°C | 250um |
| | 30°C | 350um |
| | 40°C | 400um |

IMAGE FORMING APPARATUS

CROSS-REFERENCE TO RELATED APPLICATIONS

This application is based on and claims priority under 35 USC 119 from Japanese Patent Application No. 2009-064637 filed on Mar. 17, 2009.

BACKGROUND

1. Technical Field

The present invention relates to an image forming apparatus.

2. Related Art

An image forming apparatus for carrying out a color printing operation includes an apparatus of a tandem type which has, for each color, an image forming portion for transferring a toner image having each color onto a paper (which is constituted by a photosensitive member, an exposing device, and the like).

In the image forming apparatus of the tandem type, image forming portions for respective colors (Y (yellow), M (magenta), C (cyan) and K (black)) carry out a printing operation over a single paper, thereby forming toner images having the four colors. Consequently, a single color image is formed.

For this reason, when a transfer timing onto a transfer belt is deviated finely due to a change in a temperature of the image forming portion or a variation with time, there is caused a so-called registration shift in which only a specific color is printed with a shift in a single image.

As a registration adjusting technique for correcting the registration shift, the image forming portion for each color transfers a registration adjusting patch onto the transfer belt, an extent of a shift of the registration adjusting patch for each color on the transfer belt from a reference position is detected by a sensor, and a write timing of the image forming portion is changed to eliminate an amount of the registration shift.

SUMMARY

According to an aspect of the invention, an image forming apparatus includes an image forming unit, a temperature measuring unit, a storing unit, a positional shift predicting correction controlling unit, a positional shift actual measurement correction controlling unit and a modifying unit. The image forming unit forms a toner image. The temperature measuring unit measures an in-apparatus temperature. The storing unit stores a first positional shift amount corresponding to the in-apparatus temperature, the first positional shift amount indicating a predictive value for a positional shift of the toner image. The positional shift predicting correction controlling unit, when an absolute value of a variation of the measured in-apparatus temperature is smaller than a threshold, controls to correct the positional shift based on the stored positional shift amount. The positional shift actual measurement correction controlling unit, when the absolute value of the variation of the measured in-apparatus temperature is equal to or greater than the threshold, controls to correct the positional shift based on a second positional shift amount detected from a positional shift correction pattern which is formed by the image forming unit. The modifying unit modifies the first positional shift amount based on the second positional shift amount when a difference between the first positional shift amount and the second positional shift amount is equal to or greater than a threshold.

BRIEF DESCRIPTION OF THE DRAWINGS

Exemplary embodiment(s) of the invention will be described in detail based on the following figures, wherein:

FIGS. 4A and 4B are diagrams showing a predictive registration control;

FIGS. 8A and 8B are diagrams showing the prediction table subjected to the modification processing;

DETAILED DESCRIPTION

An example according to the invention will be described below in detail with reference to the accompanying drawings.

First of all, a structure of an image forming apparatus 1 according to the invention will be described with reference to FIG. 1.

Figure 1:
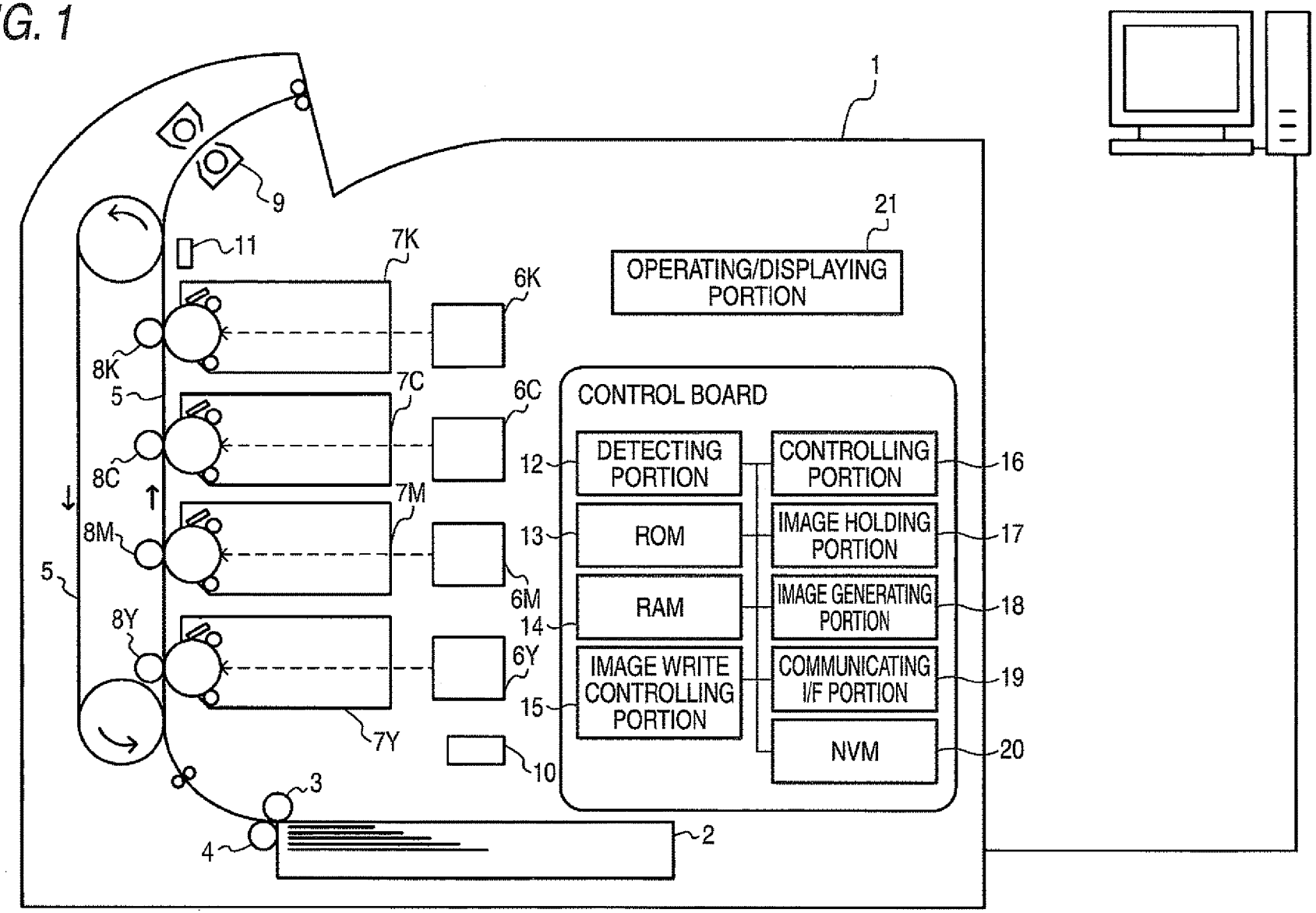
FIG. 1 is a typical view showing a functional structure of an image forming apparatus 1.

FIG. 1 is a typical view showing a functional structure of the image forming apparatus 1.

As shown in FIG. 1, the image forming apparatus 1 has a paper feeding tray 2, a pickup roller 3, a retard roller 4, a transferring and delivering belt 5, an exposing device 6 (an exposing device 6Y, an exposing device 6M, an exposing device 6C and an exposing device 6K), a cartridge 7 (a cartridge 7Y, a cartridge 7M, a cartridge 7C and a cartridge 7K), a transferring device 8 (a transferring device 8Y, a transferring device 8M, a transferring device 8C and a transferring device 8K), a fixing device 9, a temperature sensor 10, a patch detecting sensor 11, a detecting portion 12, an ROM (Read Only Memory) 13, an RAM (Random Access Memory) 14, an image write controlling portion 15, a controlling portion 16, an image holding portion 17, an image forming portion 18, a communicating I/F portion 19, an NVM (Non-volatile Memory) 20, and an operating/displaying portion 21.

In detail, the exposing device 6Y for Y (yellow), the exposing device 6M for M (magenta), the exposing device 6C for C (cyan) and the exposing device 6K for K (black) are generally referred to as the exposing device 6.

In detail, the cartridge 7Y for Y (yellow), the cartridge 7M for M (magenta), the cartridge 7C for C (cyan) and the cartridge 7K for K (black) are generally referred to as the cartridge 7.

In detail, the transferring device 8Y for Y (yellow), the transferring device SM for M (magenta), the transferring device 8C for C (cyan) and the transferring device 8K for K (black) are generally referred to as the transferring device 8.

The image forming apparatus 1 is of a tandem type including image forming portions constituted by the exposing devices 6, the cartridges 7 and the transferring devices 8 for the respective colors (Y (yellow)), M (magenta), C (cyan) and K (black)).

The paper feeding tray 2 accommodates a paper to be used for forming an image.

The pickup roller 3 carries out a processing for feeding the paper accommodated in the paper feeding tray 2 to a delivering path.

The retard roller 4 functions to feed the papers from the paper feeding tray 2 one by one.

The transferring and delivering belt 5 has a function for delivering the paper and an image having each color is formed on the paper delivered through the transferring and delivering belt 5 by means of the cartridges 7Y, 7M, 7C and 7K for the respective colors which are positioned near the transferring and delivering belt 5.

Moreover, patch images having the respective colors are formed on the transferring and delivering belt 5 by the cartridges 7Y, 7M, 7C and 7K for the respective colors in order to carry out a registration control of the image forming apparatus 1.

The exposing device 6 (the exposing device 6Y, the exposing device 6M, the exposing device 6C and the exposing device 6K) is constituted by a semiconductor laser or a polygon mirror for deflecting and scanning a laser beam, and forms electrostatic latent images of image data for the respective colors on photosensitive members present in the cartridges 7 (7Y, 7M, 7C and 7K).

The cartridge 7 (the cartridges 7Y, 7M, 7C and 7K) includes a charging device, a photosensitive member, a developing device and a cleaner in the cartridges for the respective colors, and develops, through the developing device, an electrostatic latent image developed onto the photosensitive member by the exposing device 6, thereby forming a toner image on the photosensitive member.

The transferring device 8 (the transferring devices 8Y, 8M, 8C and 8K) transfers toner images on the photosensitive members for the respective colors in the cartridge 7 onto the paper delivered by means of the transferring and delivering belt 5.

The fixing device 9 carries out a processing for fixing, onto the paper, an unfixed toner image which is held on the paper.

The temperature sensor 10 is positioned in the vicinity of the exposing device 6 and serves to measure a change in a temperature of the exposing device 6.

The patch detecting sensor 11 is a concentration sensor constituted by an optical sensor, and serves to measure a registration adjusting patch formed on the transferring and delivering belt 5.

Moreover, the pattern detecting sensor 11 may be used as a sensor for detecting a process controlling patch to regulate a concentration of a toner image formed by the cartridge 7.

The detecting portion 12 provided on a control board detects the registration adjusting patch which is output from the pattern detecting sensor 11.

The ROM 13 stores firmware for operating the image forming apparatus 1.

The RAM 14 constitutes a work area for storing various data such as system data to control the operation of the apparatus.

The image write controlling portion 15 controls an operation for causing the exposing device 6 (the exposing devices 6Y, 6M, 6C and 6K) to write the electrostatic latent image to the cartridge 7 (the cartridges 7Y, 7M, 7C and 7K).

A registration shift is corrected by a control, for example, a regulation of a timing for writing the electrostatic latent image by the exposing device 6.

The controlling portion 16 chiefly controls the image forming apparatus 1.

The image holding portion 17 functions to spool a printing job which is intended for printing.

The image generating portion 18 generates a bit map image to be printed by the printing job.

A communication line for carrying out a communication with an outside is connected to the communicating I/F portion 19, and the communicating I/F portion 19 receives information about the printing job through the communication line.

The NVM 20 is a nonvolatile memory and stores a prediction table to be used for a predicted registration control which will be described below and a temperature at which the registration control is carried out.

The operating/displaying portion 21 is a user interface constituted by a liquid crystal touch panel.

Referring to the image forming apparatus 1 having the structure, a write timing of the exposing device 6 is deviated due to a rise in an in-machine temperature or a variation with time so that a registration shift is caused, that is, a color of a toner image formed with a shift is printed with a shift over a paper differently from other colors in some cases.

In the image forming apparatus 1, two types of registration controls including a patch registration control and a predicted registration control are carried out to correct the registration shift.

In the patch registration control, a registration adjusting patch is formed on the transferring and delivering belt 5 and they are measured by the patch detecting sensor 11, a shift from a reference position of the registration adjusting patch thus measured is measured, and the image write controlling portion 15 controls the exposing device 6 in order to correct the shift amount.

In the predicted registration control, the registration shift amount is predicted based on the temperature measured by the temperature sensor 10 and the prediction table, and the image write controlling portion 15 controls the exposing device 6 in order to correct the shift amount.

Next, the registration adjusting patch formed on the transferring and delivering belt 5 in the patch registration control will be described with reference to FIG. 2.

Figure 2:
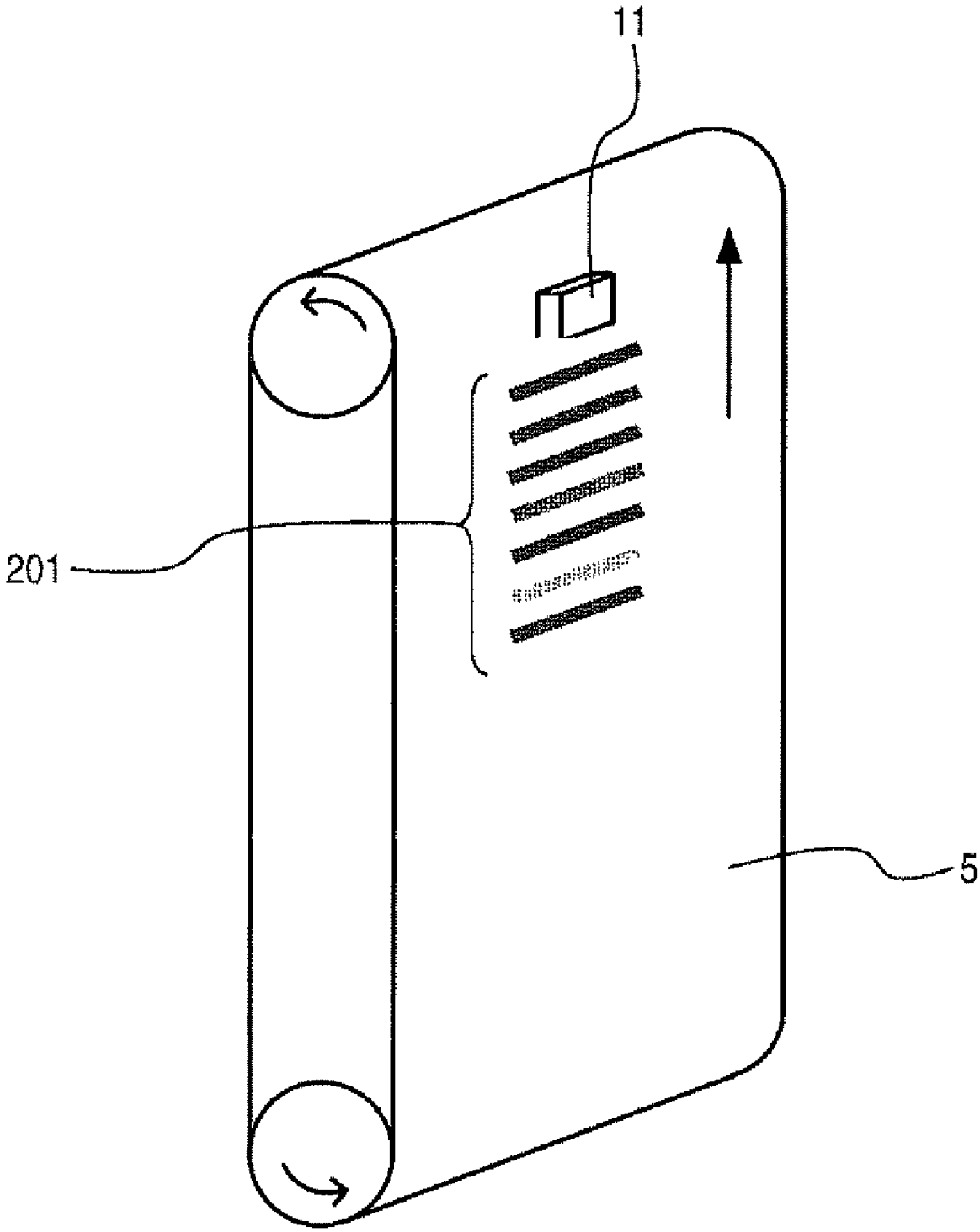
FIG. 2 is a typical view showing a registration adjusting patch.

FIG. 2 is a typical view showing the registration adjusting patch formed on the transferring and delivering belt 5.

As shown in FIG. 2, in the patch registration control, the registration adjusting patch is formed on the transferring and delivering belt 5 by the image forming portion for each color, and passes through a region detected by the patch detecting sensor 11 with a movement of the transferring and delivering belt 5.

Then, the registration adjusting patch is measured by the patch detecting sensor 11.

Next, data transmitted from the patch detecting sensor 11 to the detecting portion 12 will be described with reference to FIG. 3.

Figure 3A:
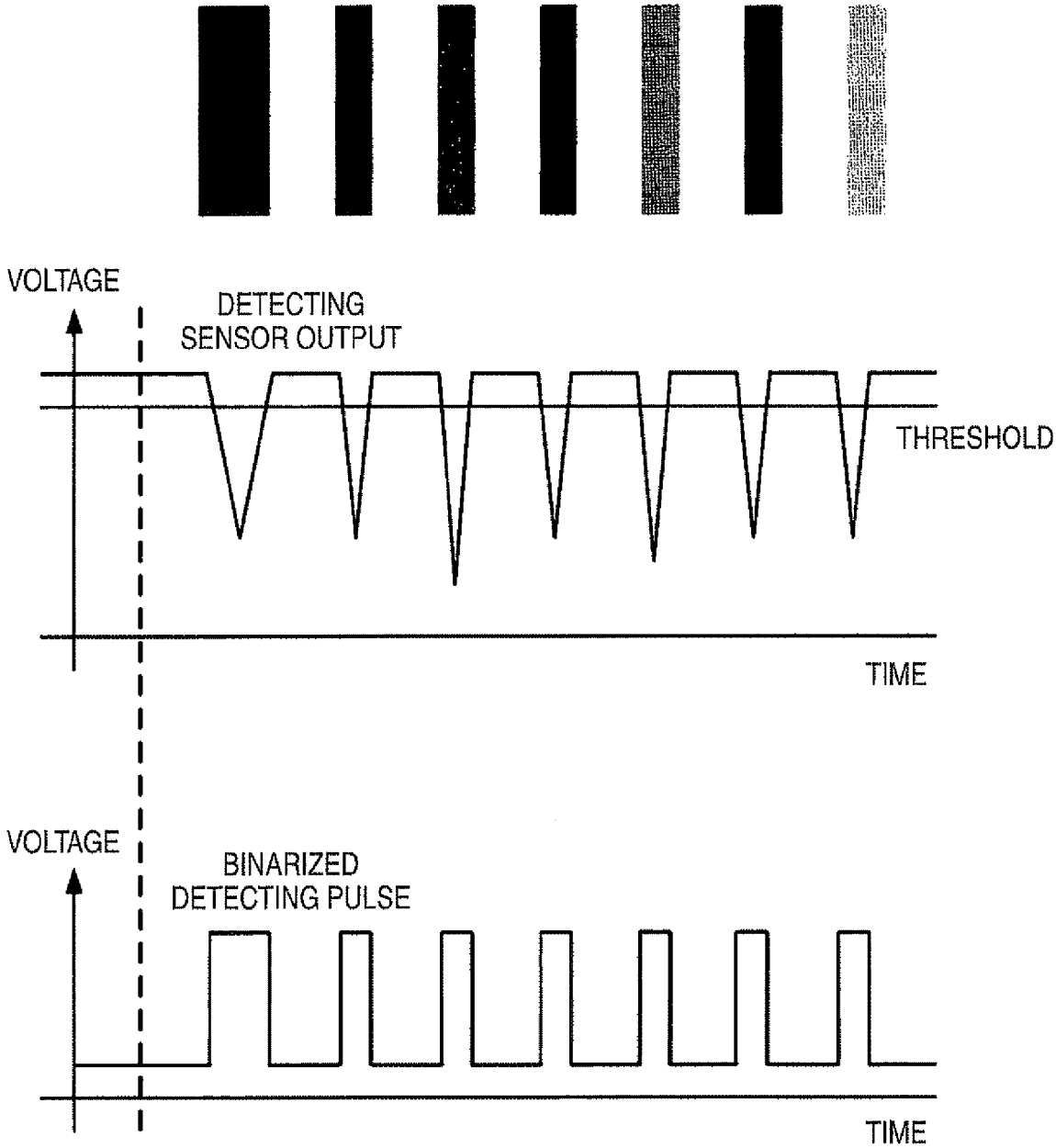
FIGS. 3A and 3B are diagrams showing a processing to be carried out in a detecting portion 12.
Figure 3B:
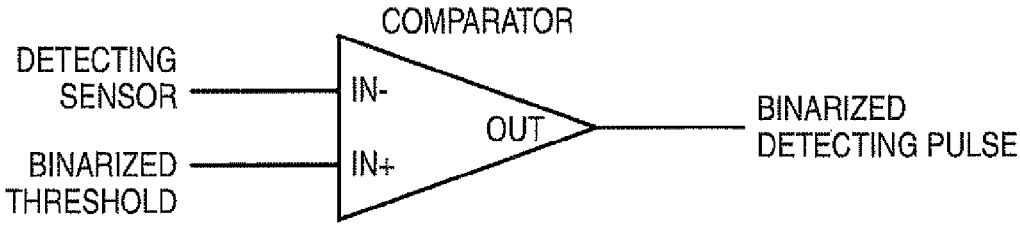

FIG. 3A is a diagram showing data to be transmitted to the detecting portion 12 and processed therein, and FIG. 3B is a typical diagram showing a comparator for carrying out a binarization through the detecting portion 12.

As shown in FIG. 3A, output data measured by the patch detecting sensor 11 have an analog value. The output data are transmitted to the detecting portion 12 and are thus converted into digital data by setting a threshold as a boundary so that a patch is detected like a pulse.

A patch interval is also detected as a pulse interval and a shift amount from a reference value of each patch is measured.

A value output from the patch detecting sensor 11 and a threshold are input to the detecting portion 12, and binarized data are output.

The patch registration control is to be carried out through an interruption of a normal printing operation. If the patch registration control is executed very often, a productivity is reduced. Since an actual shift amount is detected to carry out an adjustment, however, the adjustment can be performed accurately.

Next, the predicted registration control will be described with reference to FIG. 4.

Figure 4B:
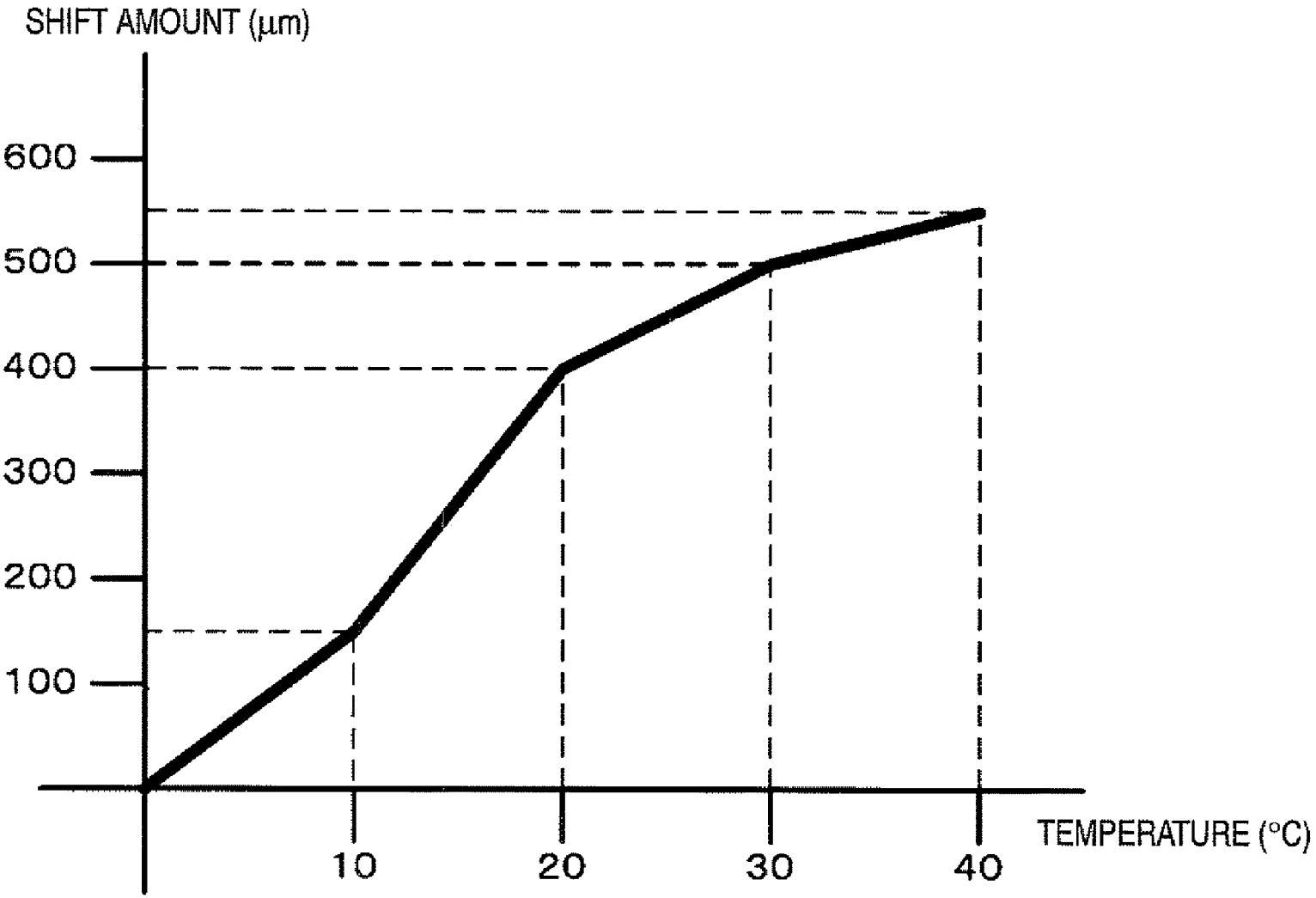

FIG. 4 are diagrams showing the predicted registration control, and FIG. 4A is a prediction table to be used for the predicted registration control and FIG. 4B is a graph constituted by values of the prediction table shown in FIG. 4A.

The prediction table shown in FIG. 4A is stored in the NVM 20.

A shift amount of a registration corresponding to a temperature is described for each color in the prediction table shown in FIG. 4A.

When the predicted registration control is to be carried out, a shift amount corresponding to the temperature measured by the temperature sensor 10 is acquired from the prediction table shown in FIG. 4A and a control is performed to correct the shift amount.

Moreover, it is also possible to calculate the shift amount corresponding to the temperature measured based on the graph shown in FIG. 4B which is constituted by the prediction table illustrated in FIG. 4A.

Although the predicted registration control can be executed without the interruption of the normal printing operation, there is caused a typical inaccuracy of the prediction control.

Next, a control of a write timing after the calculation of the shift amount will be described with reference to FIG. 5.

Figure 5:
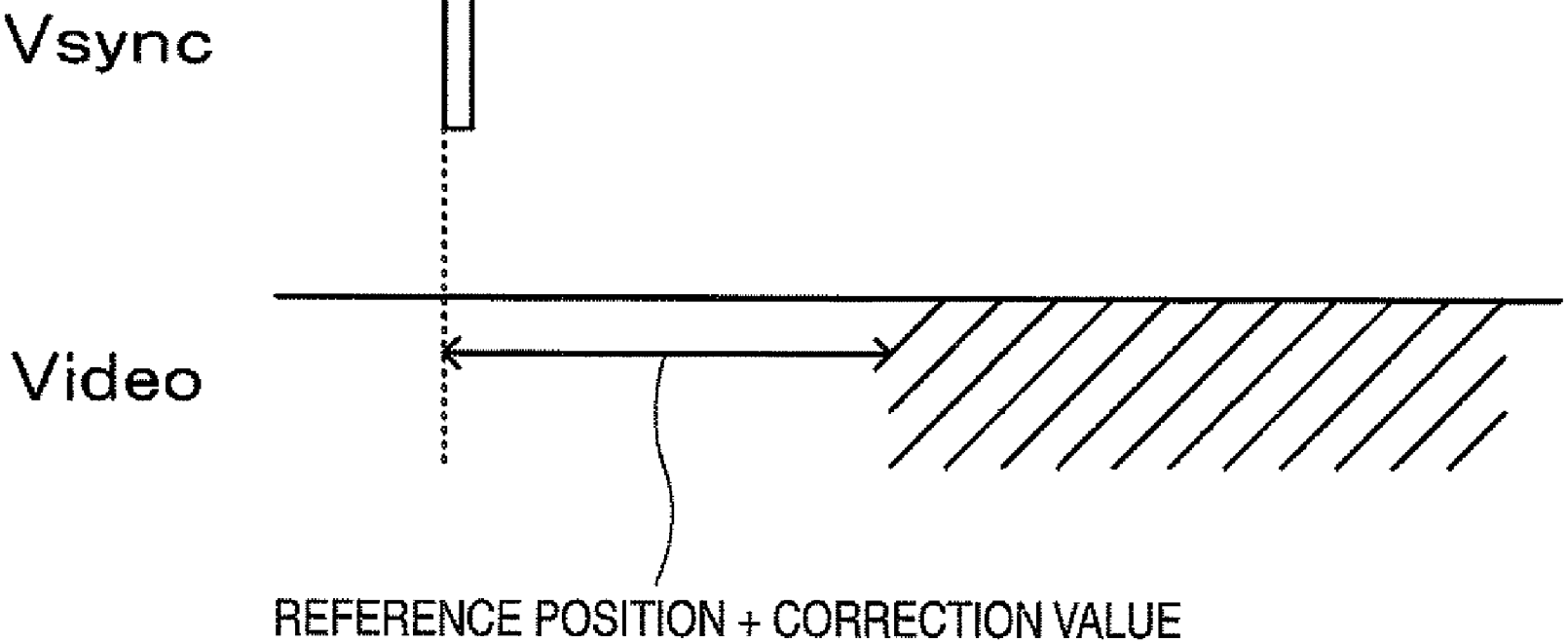
FIG. 5 is a diagram showing a processing for correcting a shift amount.

FIG. 5 is a diagram showing a processing for correcting the shift amount calculated by the patch registration control or the predicted registration control.

When the shift amount is calculated, the image write timing of the exposing device 6 is controlled in such a direction as to correct the shift amount by the control of the image write controlling portion 15 as shown in FIG. 5.

Next, a processing obtained by combining the patch registration control and the predicted registration control which are carried out in the image forming apparatus 1 will be described with reference to FIG. 6.

Figure 6:
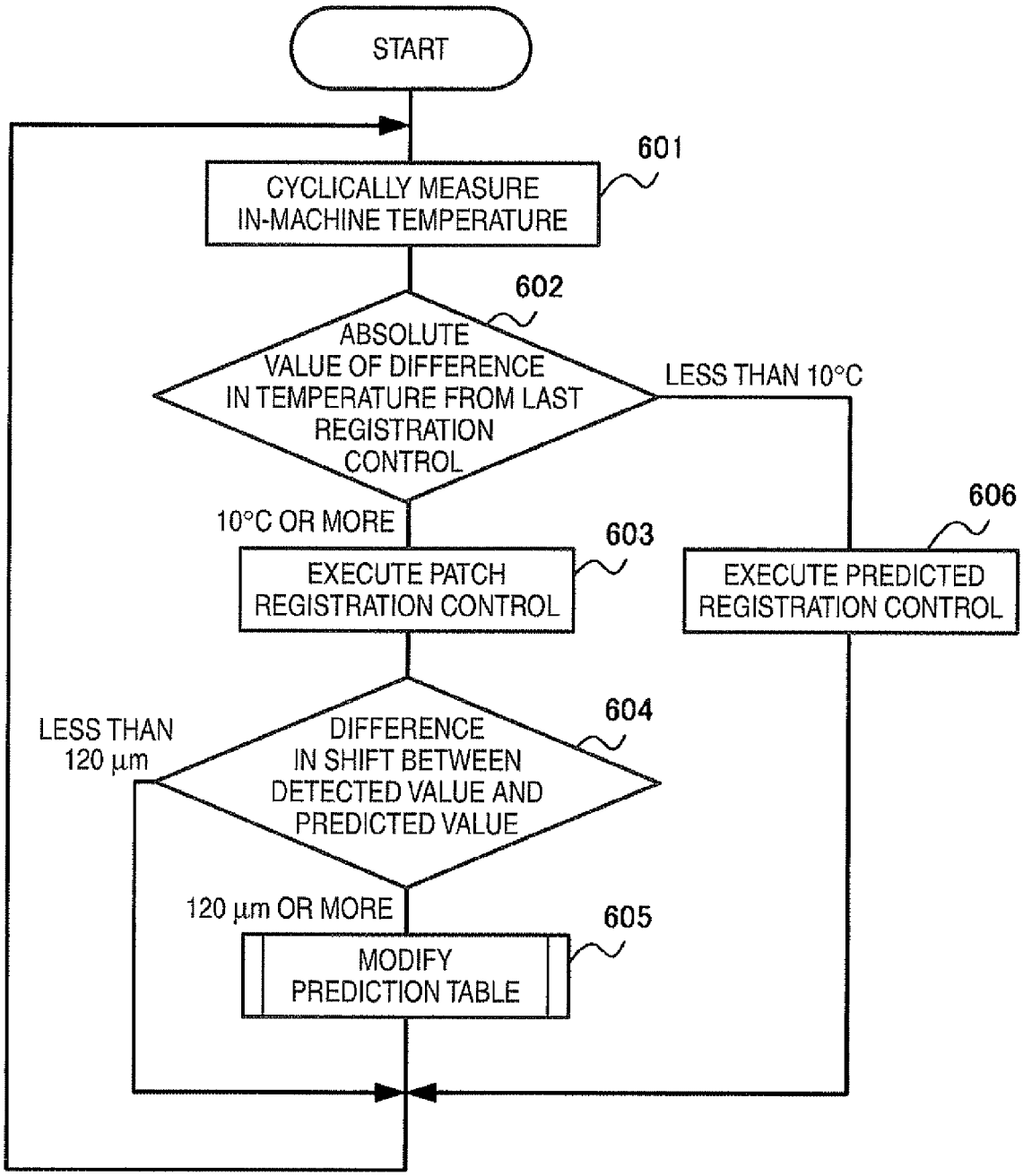
FIG. 6 is a flowchart showing a processing to be carried out in the image forming apparatus 1.

FIG. 6 is a flowchart showing a processing to be a basis for combining the patch registration control and the predicted registration control which are carried out in the image forming apparatus 1.

First of all, the temperature sensor 10 of the image forming apparatus 1 cyclically measures an in-machine temperature (Step 601).

A temperature at which a registration control is carried out at a last time is stored in the NVM 20. If an absolute value of a difference between the temperature and the in-machine temperature measured at the Step 601 is equal to or greater than 10 degrees (10 degrees or more in Step 602), the patch registration control described with reference to FIGS. 2 and 3 is executed (Step 603).

The in-machine temperature measured in the Step 601 is stored, in the NVM 20, as a temperature at which the newest patch registration control is carried out while the patch registration control is executed at the Step 603.

Description will be given by taking, as an example, the case in which the temperature measured at the Step 601 and stored in the NVM 20 is 20 degrees.

Then, a difference between a shift amount detected by an execution of the patch registration control (Step 603) and a shift amount predicted based on the prediction table at a temperature in the execution of the patch registration control is calculated by the controlling portion 16 (Step 604).

For example, if the shift amount detected by the execution of the patch registration control (Step 603) is 250 μm, the shift amount predicted based on the prediction table shown in FIG. 4A is 400 μm because the temperature in the execution of the patch registration control is 20 degree stored in the NVM 20.

Therefore, a difference between the shift amount (250 μm) detected through the patch registration control and the shift amount (400 μm) predicted based on the prediction table is 150 μm.

Thereafter, it is ascertained, by the controlling portion 16, whether the difference between the shift amounts thus calculated is equal to or greater than a predetermined value or not (Step 604).

If the ascertainment is carried out by the controlling portion 16 so that the difference between the shift amounts which is calculated is equal to or greater than 120 μm (120 μm or more in the Step 604), the shift amount predicted based on the prediction table is inaccurate. Therefore, a processing for modifying the value of the prediction table is carried out based on the shift amount detected through the patch registration control (Step 605).

Next, the processing for modifying the value of the prediction table corresponding to a subroutine of the Step 605 will be described with reference to FIG. 7.

Figure 7:
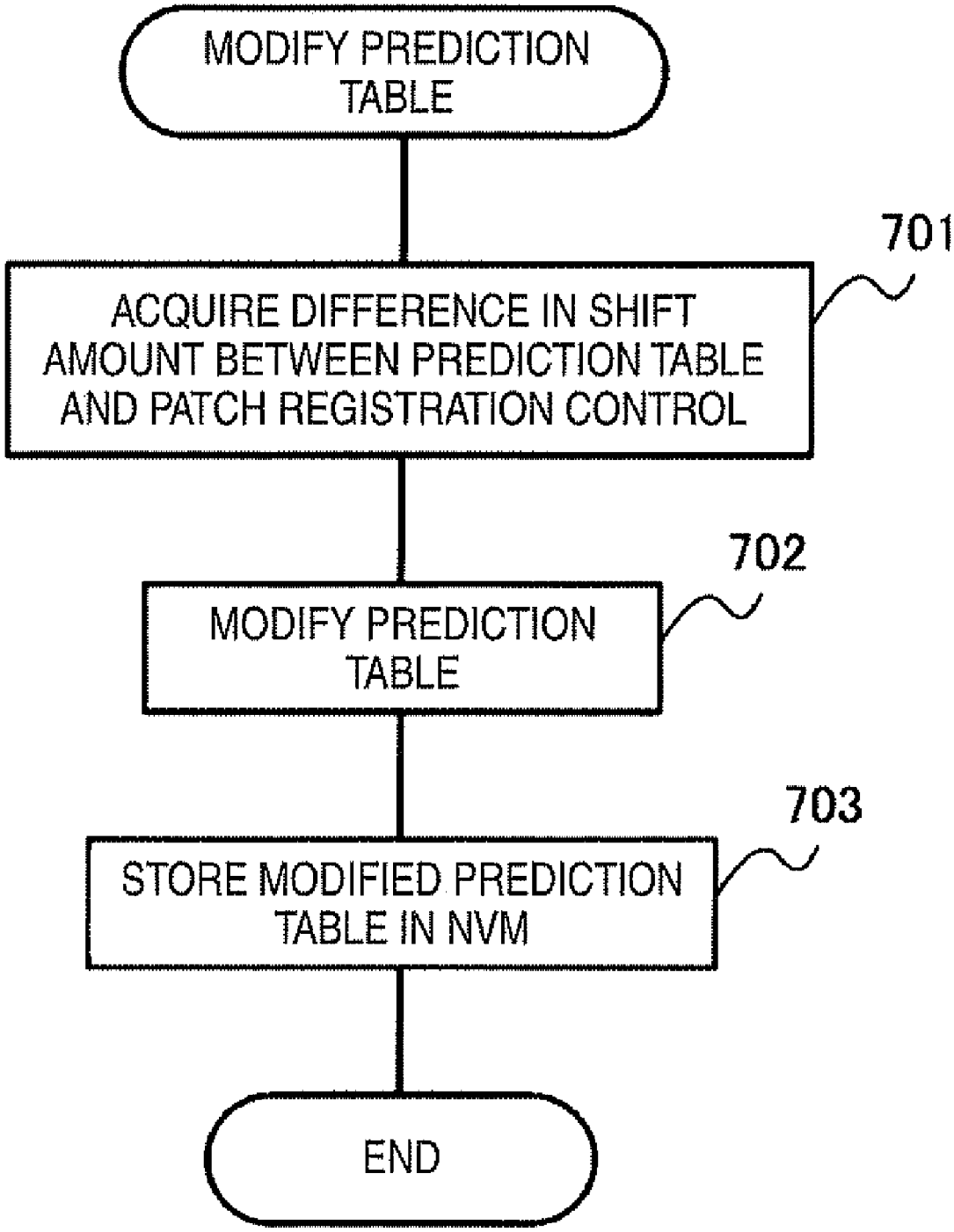
FIG. 7 is a flowchart showing a processing for modifying a value of a prediction table.

FIG. 7 is a flowchart showing the processing for modifying the value of the prediction table.

First of all, the difference between the shift amount detected through the patch registration control and the shift amount predicted based on the prediction table is acquired by the controlling portion 16 (Step 701).

The shift amount in the prediction table for the temperature in the execution of the patch registration control is calculated as the shift amount predicted based on the prediction table, and a difference between a value thus obtained and the shift amount detected through the patch registration control is calculated (Step 701).

The difference between the shift amounts which is acquired at the Step 701 has an equal value to the difference between the shift amounts which is calculated at the Step 604. Therefore, the value calculated at the Step 604 may be used.

The difference between the shift amounts which is acquired is 150 μm (the predicted value in the prediction table is greater).

As the processing for modifying the value of the prediction table, then, a value of the difference acquired at the Step 701 is used to carry out a calculation in order to cause the shift amount predicted based on the prediction table at the temperature (20 degrees) at which the difference between the shift amounts is calculated to be set into a value of the shift amount detected through the patch registration control (in this case, since the value predicted based on the prediction table is greater, a calculation for subtracting "the value of the difference" from the value of the prediction table is carried out) (Step 702).

The calculation is carried out for values of the other temperatures in the prediction table in the same manner (Step 702).

In other words, there is carried out the calculation for subtracting "the value of the difference" from the value of the prediction table which is the same calculation for shift amounts of the other temperatures described in the prediction table.

More specifically, "the difference between the shift amounts" of 150 μm is subtracted from the shift amounts described in the prediction table shown in FIG. 4A, respectively.

FIG. 8A shows a result obtained by the calculation processing for each of the values in the prediction table of FIG. 4A.

As shown in FIG. 8A, for example, the calculation processing is carried out to modify a shift amount of zero degree from "0 μm" to "−150 μm" and a shift amount of 10 degrees from "150 μm" to "0 μm".

Figure 8B:
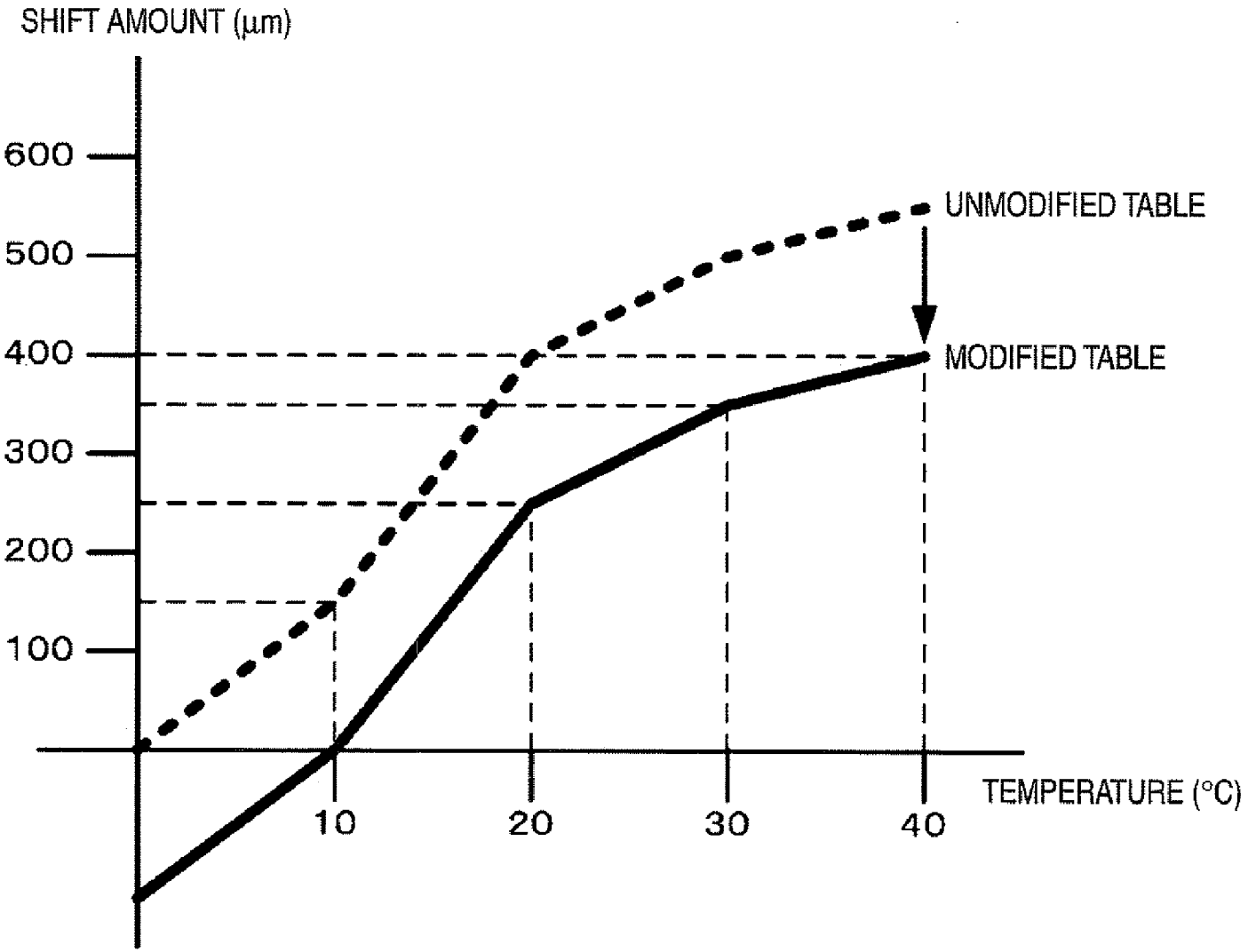

In the case in which the prediction table subjected to the calculation processing and the modification is indicated as a graph in which the values of the prediction table are plotted as shown in FIG. 8B, a graph obtained after the modification takes a configuration in which a graph subjected to no modification is moved in parallel by −150 μm in an axial direction representing the shift amount.

The prediction table thus subjected to the calculation processing and the modification is overwritten and stored in the NVM 20 (Step 703).

If the difference between the shift amounts which is calculated is not equal to or greater than the predetermined value at the Step 604 (120 μm or less in the Step 604), moreover, the processing for modifying the values of the prediction table is not carried out.

If the absolute value of the difference between the temperature at which the last registration control stored in the NVM 20 is carried out and the in-machine temperature measured at the Step 601 is smaller than 10 degrees (10 degrees or less in the Step 602) at the Step 602, moreover, the predicted registration control described with reference to FIG. 4 is executed (Step 606).

After the patch registration control is thus carried out as in the image forming apparatus 1, it is also possible to perform a processing for changing the threshold to be decided at the Step 602.

Next, the processing for changing the threshold to be decided at the Step 602 in the image forming apparatus 1 will be described with reference to FIG. 9.

Figure 9:
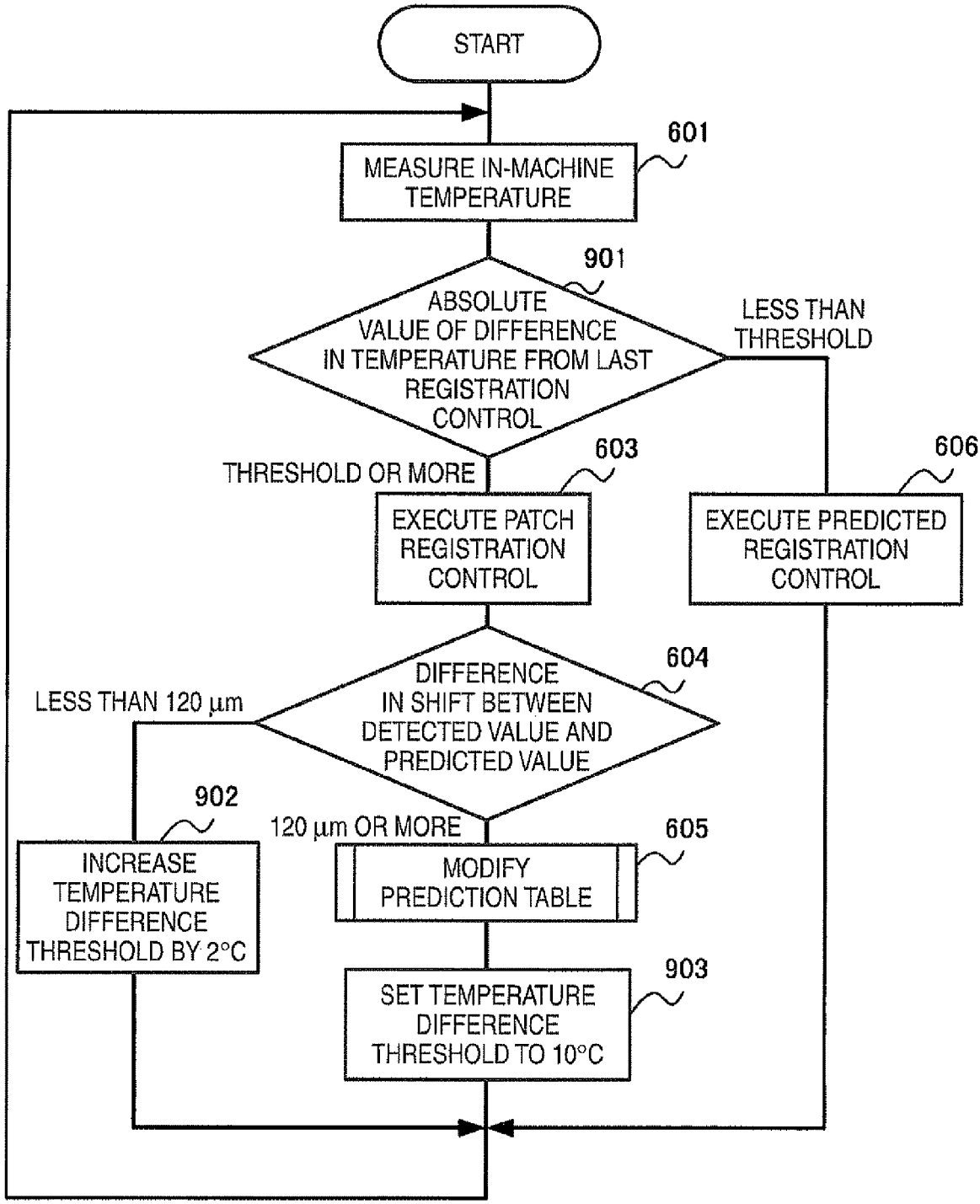
FIG. 9 is a flowchart showing a processing including a change in a deciding threshold.

FIG. 9 is a flowchart showing a processing including the processing for changing the threshold to be decided at the Step 602 after the patch registration control in the processing described with reference to FIG. 6.

In the flowchart of FIG. 9, a flow for carrying out the same processing as that in FIG. 6 has the same reference numeral.

First of all, the image forming apparatus 1 cyclically measures a temperature through the temperature sensor 10 (Step 601).

Then, it is decided whether an absolute value of a difference between a temperature in an execution of a last registration control and an in-machine temperature which is measured is equal to or greater than a value of a threshold (10 degrees in a default) or not (Step 901).

If the absolute value is equal to or greater than 10 degrees at Step 602 (the threshold or more in the Step 901), a patch registration control is executed (Step 603).

If a difference between a shift amount detected through the patch registration control and a shift amount predicted based on a prediction table at a temperature in the execution of the patch registration control is smaller than a predetermined value (120 μm) as a result of the execution of the patch registration control (less than 120 μm in the Step 604), thereafter, the threshold in the Step 901 is increased by two degrees.

More specifically, the threshold is set to be 10 degrees in the Step 901. Therefore, the processing is subsequently carried out by setting the threshold to be 12 degrees obtained with an increase of two degrees.

If the difference between the shift amount detected through the patch registration control and the shift amount predicted based on the prediction table at the temperature in the execution of the patch registration control is equal to or greater than the predetermined value (120 μm or more) at the Step 604 as the result of the execution of the patch registration control, the value of the prediction table is modified as described with reference to FIGS. 7 and 8 (Step 605).

When the value of the prediction table is modified (Step 605), the threshold is set to be 10 degrees if the threshold in the processing at the Step 901 is not 10 degrees (Step 903).

If the patch registration control is executed (Step 603) and the difference between the shift amount detected through the patch registration control and the shift amount predicted based on the prediction table is smaller than the predetermined value (less than 120 μm in the Step 604), thus, a reliability of the prediction table is increased. Therefore, the threshold in the Step 901 is changed in such a manner that the predicted registration control is carried out more often.

In the image forming apparatus 1, it is possible to carry out a processing for executing the patch registration control and modifying the prediction table in a timing specified by a user.

Next, a processing for executing the patch registration control in order to modify the prediction table when it is desired by the user will be described with reference to FIG. 10.

Figure 10:
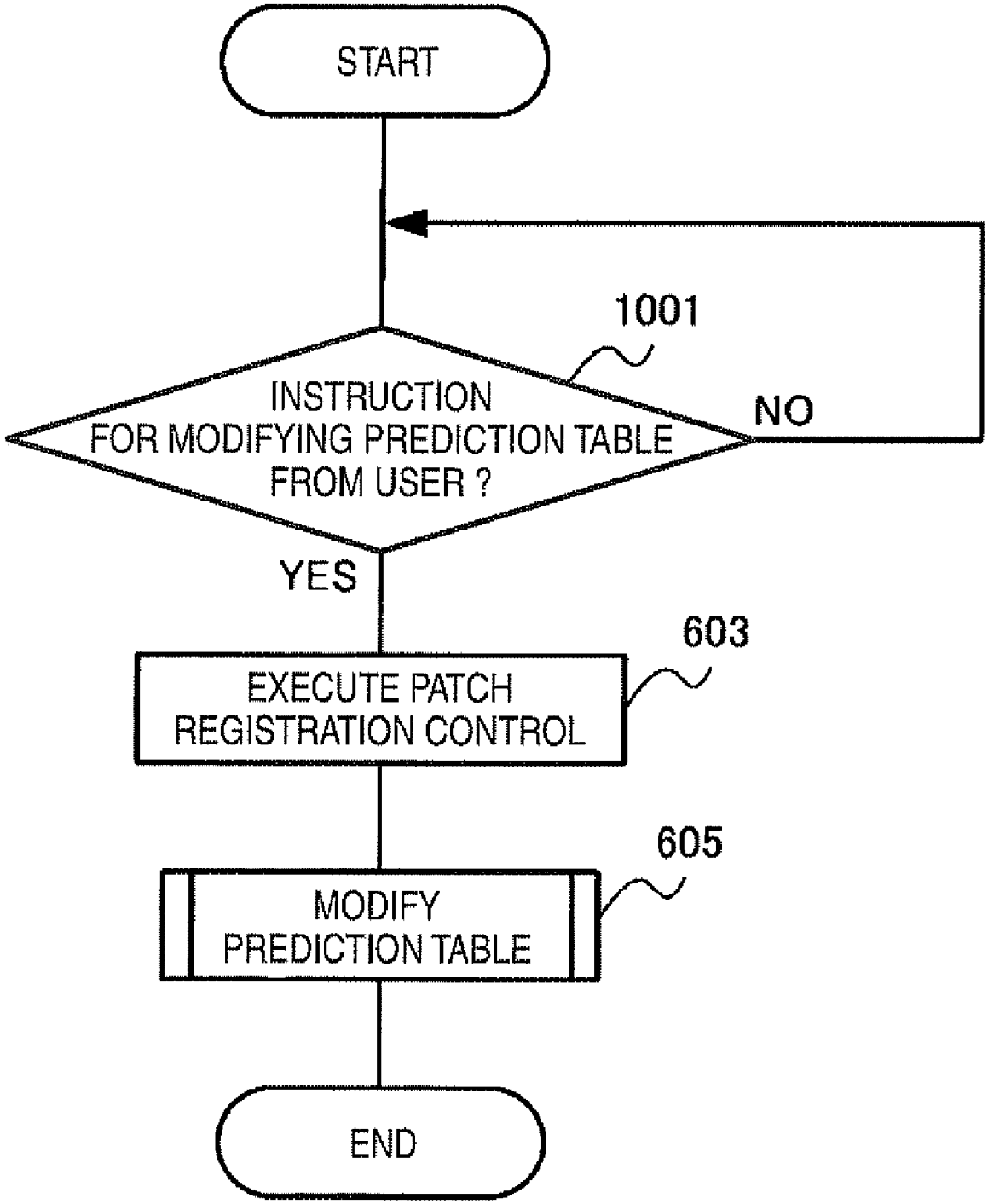
FIG. 10 is a flowchart showing a processing for modifying the prediction table in response to an instruction of a user.

FIG. 10 is a flowchart showing a processing for executing the patch registration control in response to an instruction of the user and modifying the prediction table in the image forming apparatus 1.

In the image forming apparatus 1, as shown in FIG. 10, an adjusting instruction is waited to be given from the user by the operating/displaying portion 21 (NO in Step 1001).

The user who is not satisfied with a result of the predicted registration control executed in the image forming apparatus 1 inputs, from the operating/displaying portion 21, an instruction for modifying the prediction table to be used in the predicted registration control.

When the instruction for modifying the prediction table is accepted from the user by the operating/displaying portion 21 (YES in the Step 1001), the controlling portion 16 executes the patch registration control of the image forming apparatus 1 (Step 603).

The patch registration control is the same processing as the patch registration control in the Step 603 described with reference to FIG. 6. Furthermore, an in-machine temperature in the execution of the patch registration control is measured by the temperature sensor 10.

After the patch registration control is carried out, then, the prediction table is modified based on a result of the patch registration control (Step 605).

The processing for modifying the prediction table is the same as the processing in the subroutine of the Step 605 as described with reference to FIGS. 6, 7 and 8.

More specifically, the prediction table is modified by setting the shift amount detected through the patch registration control carried out at the Step 603 as a shift amount in the prediction table corresponding to a temperature in the execution of the patch registration control. Referring to a shift amount of a temperature other than the temperature in the execution of the patch registration control, similarly, a difference between the shift amounts is subjected to a calculation processing and is thus modified in the same manner as described with reference to FIGS. 7 and 8.

Although the description has been given on the assumption that the threshold to be decided at the Step 604 is 120 μm, it is also possible to set any predetermined value.

The last registration control to be the basis for making the decision in the Step 602 may be restricted to only the patch registration control in place of both the patch registration control and the predicted registration control.

The invention can be utilized in an image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms a toner image;

a temperature measuring unit that measures an in-apparatus temperature;

a storing unit that stores a first positional shift amount corresponding to the in-apparatus temperature, the first positional shift amount indicating a predictive value for a positional shift of the toner image;

a positional shift predicting correction controlling unit, when an absolute value of a variation of the measured in-apparatus temperature is smaller than a threshold temperature, controls to correct the positional shift based on the stored positional shift amount;

a positional shift actual measurement correction controlling unit, when the absolute value of the variation of the measured in-apparatus temperature is equal to or greater than the threshold temperature, controls to correct the positional shift based on a second positional shift amount detected from a positional shift correction pattern which is formed by the image forming unit; and a modifying unit that modifies the first positional shift amount based on the second positional shift amount when a difference between the first positional shift amount and the second positional shift amount is equal to or greater than a threshold of a shift amount, wherein when the difference between the first positional shift amount and the second positional shift amount is smaller than the threshold of the shift amount, the threshold temperature is increased by a predetermined value, and the threshold temperature is a decision criterion for which one of the controls by the positional shift predicting correction controlling unit and the positional shift actual measurement correction controlling unit is performed.

2. The image forming apparatus according to claim 1, wherein the modifying unit sets the first positional shift amount into the second positional shift amount for modifying the first positional shift amount.

3. The image forming apparatus according to claim 1, wherein the modifying unit carries out calculation processing which adds to the first positional shift amount a value calculated by subtracting the first positional shift amount from the second positional shift amount.

4. The image-forming apparatus according to claim 1, further comprising;

an accepting unit that accepts, from an operator, an instruction for executing the control of the positional shift actual measurement correction controlling unit and the control of the modifying unit, wherein the control of the positional shift actual measurement correction controlling unit and the control of the modifying unit is executed when the instruction is accepted by the accepting unit.

5. The image forming apparatus according to claim 1, wherein an output from a detecting sensor output is compared to a sensor threshold to obtain a binarized detecting pulse used in determining the second positional shift amount.

6. An image forming apparatus comprising:

an image forming unit that forms a toner image;

a temperature measuring unit that measures an in-apparatus temperature at a predetermined timing;

a storing unit that stores a first positional shift amount corresponding to the in-apparatus temperature, the first positional shift amount indicating a predictive value for a positional shift of the toner image;

a first correction controlling unit that performs a first control of correcting the positional shift of the toner image based on the first positional shift amount stored in the storing unit;

a second correction controlling unit that performs a second control of correcting the positional shift of the toner image based on a second positional shift amount detected from a positional shift correction pattern which is formed by the image forming unit;

a determining unit that determines which one of the first control and the second control is performed based on whether an absolute value of a temperature difference between a current in-apparatus temperature and a previous in-apparatus temperature measured by the temperature measuring unit is smaller than a threshold temperature difference when the temperature measuring unit measures the current in-apparatus temperature;

a first modifying unit that modifies the first positional shift amount based on the second positional shift amount when a shift amount difference between the first positional shift amount and the second positional shift amount is equal to or greater than a threshold shift amount difference; and a second modifying unit that modifies the threshold temperature difference to increase by a predetermined amount when the shift amount difference between the first positional shift amount and the second positional shift amount is smaller than the threshold shift amount difference.

7. The image forming apparatus according to claim 6, wherein an output from a detecting sensor output is compared to a sensor threshold to obtain a binarized detecting pulse used in determining the second positional shift amount.

* * * * *